US007364476B2

(12) United States Patent
Mueller

(10) Patent No.: US 7,364,476 B2
(45) Date of Patent: Apr. 29, 2008

(54) ELECTRICAL CONNECTING TERMINAL ASSEMBLY

(75) Inventor: Bernhard Mueller, Zimmern (DE)

(73) Assignee: Friedrich Goehringer Elektrotechnik GmbH, Triberg (DE)

( * ) Notice: Subject to any disclaimer, the term of this patent is extended or adjusted under 35 U.S.C. 154(b) by 0 days.

(21) Appl. No.: 11/531,868

(22) Filed: Sep. 14, 2006

(65) Prior Publication Data

US 2007/0117470 A1 May 24, 2007

(30) Foreign Application Priority Data

Sep. 14, 2005 (DE) ..... 20 2005 014 577 U

(51) Int. Cl.
*H01R 9/22* (2006.01)

(52) U.S. Cl. ..... 439/709

(58) Field of Classification Search ..... 439/810, 439/811, 812, 814, 709, 793, 518, 364, 575
See application file for complete search history.

(56) References Cited

U.S. PATENT DOCUMENTS

| | | | | |
|---|---|---|---|---|
| 2,764,749 | A | 9/1956 | Aberle | 439/588 |
| 3,124,409 | A * | 3/1964 | Nisula | 439/791 |
| 3,656,086 | A * | 4/1972 | Debaigt | 439/518 |
| 3,794,963 | A * | 2/1974 | Cooper, Jr. | 439/798 |
| 4,603,376 | A * | 7/1986 | Maier | 361/824 |
| 4,758,186 | A * | 7/1988 | Barriuso et al. | 439/723 |
| 5,203,716 | A * | 4/1993 | Martucci et al. | 439/411 |
| 5,919,057 | A * | 7/1999 | Kameyama | 439/364 |
| 6,174,199 | B1 * | 1/2001 | Rushing | 439/575 |
| 6,231,405 | B1 * | 5/2001 | Diconne et al. | 439/812 |
| 6,649,838 | B1 * | 11/2003 | Lopez et al. | 174/67 |
| 2006/0121772 | A1 * | 6/2006 | Hoffman et al. | 439/397 |

FOREIGN PATENT DOCUMENTS

| | | |
|---|---|---|
| DE | 1 765 816 U | 3/1958 |
| DE | 81 23 067 | 10/1981 |
| DE | 08714542 | 8/1988 |
| GB | 1251112 | 10/1971 |

* cited by examiner

*Primary Examiner*—Chandrika Prasad
(74) *Attorney, Agent, or Firm*—Akerman Senterfitt; Stephen A. Pendorf; Peter A. Chiabotti

(57) ABSTRACT

A connecting terminal (10) for a busbar is provided and can include an electrically insulated housing (20), in which an electrically conductive clamp body (40) is provided with a first clamp screw (41) for fixing a connector cable (50) and a contact for a terminal lug (60), where the connector cable (50) is insertable into the clamp body (40) through an inlet opening (25) of the housing (20), and where the terminal lug is insertable into the housing (20) through an outlet opening (26*a*, 26*b*) of the housing (20), where one hollow cylinder (30, 80) is formed on the housing around the inlet opening (25) for the connector cable (50) and around the outlet opening (26*a*, 26*b*) for the terminal lug (60).

18 Claims, 4 Drawing Sheets

ELECTRICAL CONNECTING TERMINAL ASSEMBLY

DESCRIPTION

Figure 1:
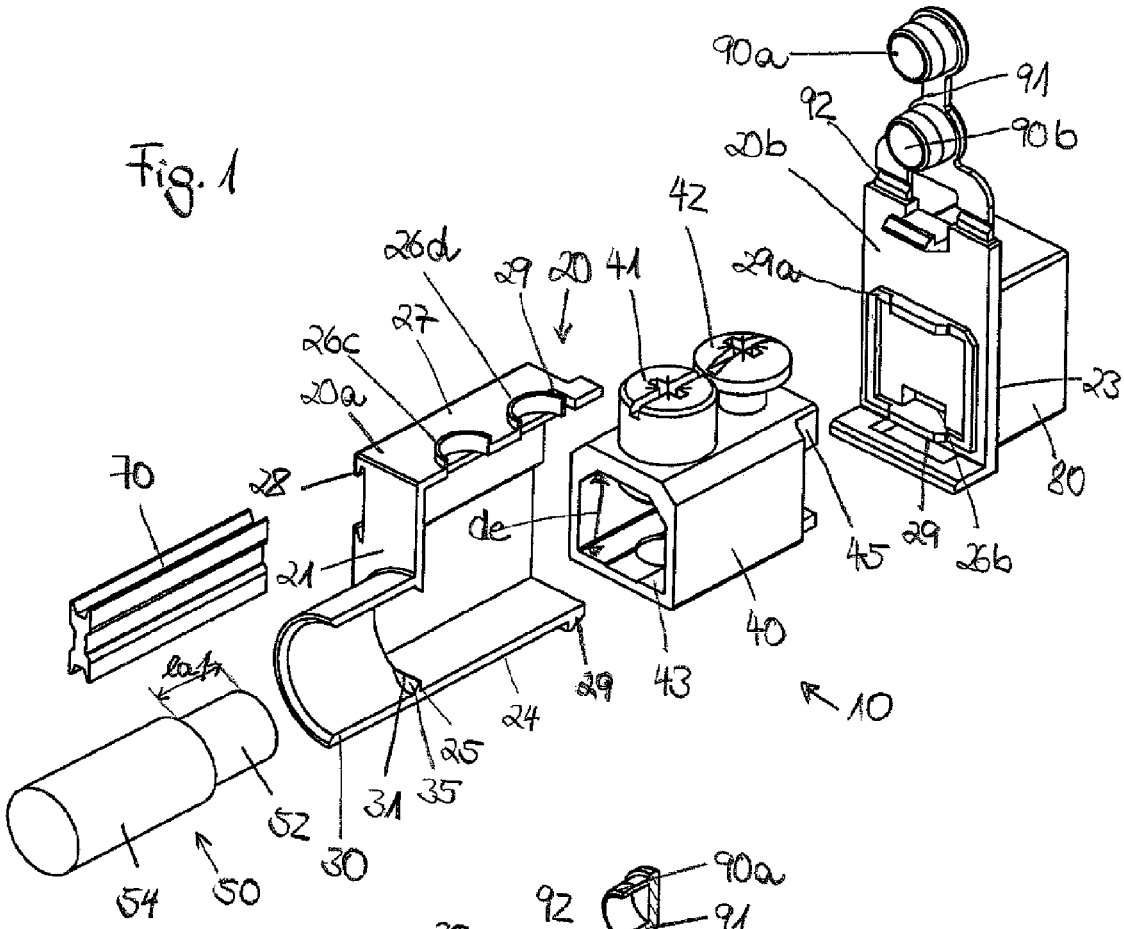

The invention concerns a connecting or connecting terminal for a busbar.

Connecting terminals for busbars with housings are known, comprising a clamp body with a first clamp screw for securing a feeder cable and second clamp screw for a terminal lug for connection to a busbar. One such connecting terminal of this type is known for example from DE 87 14 542. Therein the connector cable is introduced through an inlet opening of the housing into the clamp body, where it is secured by the first clamp screw. To accomplish this however insulation must be stripped from a part of the connector cable, in order to make a conductive connection between the internal conductor of the connector cable and the clamp body. As a rule insulation is removed from the connector cable to the extent that even after connection with the clamp body a part of the uninsulated connector cable extends from the housing. There is thus the danger that a person could contact the internal conductor of the connector cable, and this could lead to injury. Even in the case that the uninsulated part of the connector cable is located exclusively within the housing following connection of the connector cable, the air gap between the uninsulated part of the connector cable and the outer surface of the housing is comparatively small. Further, the terminal lug is also inserted into the housing through the outlet opening. As a rule, the terminal lug includes absolutely no insulation, so that there may be the danger that a user contacts the terminal lug and and injure themselves.

In particular, this type of connecting terminal does not satisfy the standards set forth in American UL 508 or UL 489, which require an air gap of at least one inch and a creepage distance of at least two inches in this type of component. Therein the air gap is defined as the shortest distance in the air between two conductive parts. The creepage distance is defined as the shortest separation along the surface of the one insulated materials between two conductive parts.

It is thus the task of the invention to so improve the known connecting terminals for busbars in the manner that the danger of injury to persons is reliably avoided and further that the connecting terminal satisfies the requirements of UL 508 or UL 489.

The task of the invention is solved by the connecting terminal for busbars as further described herein.

Advantageous embodiments and further the developments of the invention are set forth herein.

The inventive connecting terminal for a busbar includes one hollow cylinder on its housing for respectively each of the inlet opening for the connector cable as well as the outlet opening for the terminal lug. This hollow cylinder increases the separation between the uninsulated part of the connector cable or as the case may be terminal lug situated within the housing and the outer space of the housing of the connecting terminal, so that even in the case that the uninsulated part of the connector cable would project partly out of the housing in the case of a connecting terminal without hollow cylinder, this part is however now covered by the hollow cylinder, so that no contacting of the uninsulated part of the connector cable or, as the case may be, terminal lug is possible. Further, as a result of the hollow cylinder, the air gap between the uninsulated part of the connector cable or as the case may be terminal lug and possible contact points on the outside of the housing is increased.

Preferably the hollow cylinder has an axial length of at least 1.27 cm (½ inch). Thereby the air gap is increased to approximately 2.54 cm (1 inch), whereby the connecting terminal satisfies the requirements of UL 508 or UL 489.

For manufacturing reasons the hollow cylinder extends, in a preferred embodiment of the invention, approximately perpendicular to the housing surface.

Preferably the hollow cylinder exhibits a round, oval or quadratic cross section, whereby the manufacturing of the housing inclusive of the hollow cylinder is further simplified.

In a particularly advantageous embodiment of the invention two openings are situated in the housing in such a manner that the clamp screws can be accessed through them. Thereby, in simple mode and manner, the clamp screws can be located within the housing, however can be actuated from outside the housing. As a result of the location of the clamp screws within the housing all conductive components are protected from contact by the user.

In order to also protect the user against contact even in the case that the clamp screw is screwed in by only a few rotations, and which thus could lie directly on the inner side of the housing below the opening, it is preferred that at one or both of these openings, preferably at both openings, a hollow cylinder is provided, which likewise increases the air gap and the creepage distance.

In a particularly advantageous embodiment of the invention a plug is provided as an alternative in at least one or both openings, preferably in both of the openings. This increases likewise the air gap and creepage distance and protects the user against direct contact with the electrically conducting clamp screws. Besides this, a plug inserted in the opening only slightly increases the component height of the clamp screw by a certain axial length in comparison to the hollow cylinders provided over the openings.

In a preferred embodiment of the invention the two plugs are formed attached via a connecting piece. Therein a separation exists between the two plugs, which corresponds to the distance between the two openings on the housing. Thereby both openings can be closed simultaneously with a single element, so that less component parts are needed, which parts could be lost.

It is particularly preferred when the connector piece is linked to the housing, preferably via a living or flexible hinge. Thereby it is ensured that the connector piece with the two plugs cannot be lost, so that following tightening of the clamp screws the openings can in every case again be closed with the plugs, so that at all times a protection of the user is ensured. Living hinges in particular are simple and economical to produce.

In an advantageous further development of the invention the inner diameter of the inlet opening is smaller than the inner diameter of the hollow cylinder. Thereby an edge or step results in the inlet opening, against which the insulation of the connector cable abuts. Therewith it is possible on the one hand to set a defined penetration depth of the connector cable and on the other hand to ensure that the insulation reaches precisely to the housing such that the air gap between the uninsulated part of the connector cable and the outer surface of the housing is as large as possible.

It is particularly preferred when the inner diameter of the inlet opening corresponds to the outer diameter of the internal conductor of the connector cable. By this dimensioning it is ensured that the insulated part of the connector cable cannot penetrate into the clamp body located in the inner space of the housing, so that only the stripped or uninsulated part of the connector cable is fixed by the first clamp screw and a good contact between the connector cable and the clamp body is ensured.

Preferably the inner diameter of the hollow cylinder is larger than the outer diameter of the connector cable, so that the connector cable can be introduced into the hollow cylinder without effort.

In a particularly preferred embodiment of the invention at least one guide slope is provided in the transition area between the hollow cylinder and the housing. This prevents the situation that the uninsulated part of the connector wire abuts against the edge between the hollow cylinder and the housing, and enables a simple and secure introduction of the internal conductor of the connector wire into the clamp body, without damaging the free end of the internal conductor of the connector wire.

Preferably the at least one guide slope is provided within the inlet opening in the to be assembled direction or orientation of the housing, since at this location of the inlet opening the danger that the internal conductor gets caught or hung up at the edge between hollow cylinder and inlet opening is particularly great. By the arrangement of the guide slope below the connector cable to be introduced this danger is avoided.

In one advantageous further development of the invention the connecting terminal is arranged in series. Thereby multiple connecting terminals can be connected with each other and be located on the busbar in space saving manner.

For this, preferably a groove extending parallel to the upper side of the housing is provided on at least one of the side walls of the housing. In the case that two substantially identical connecting terminals should be provided adjacent to each other, then a projection which is shaped to matingly engage with the groove of a further connecting terminal can be inserted into the groove formed in the adjacent connecting terminal, so that the connecting terminals can be joined to each other and cannot pivot relative to each other. Preferably however both sides of the housing exhibit a groove extending parallel to the upper side of the housing wherein two adjacent connecting terminals can be joined via a separate feather key, which simultaneously engages in both grooves of the side walls situated adjacent to each other. Thereby it is ensured that the width of the connecting terminal is not widened by the shaped projection. In particular, when no further connecting terminal is to be provided next to the connecting terminal, a protruding projection is not present.

It is particularly preferred when the projection is dove-tail shaped in order to ensure a simple yet secure sequential arrangement of connecting terminals.

The invention will be described in greater detail on the basis of the illustrative example shown in the figures. There is shown in FIG. 1 a partial sectional exploded representation of an illustrative embodiment of a connecting terminal and a connector cable to be introduced, FIG. 2 a partial sectional view of the connecting terminal according FIG. 1 in assembled condition, FIG. 3 a perspective view of the connecting terminal according to FIG. 1, FIG. 4 a perspective view of a further illustrative embodiment of a connecting terminal, FIG. 5 a perspective view of yet another illustrative embodiment of a connecting terminal corresponding to FIG. 3

Figure 2:
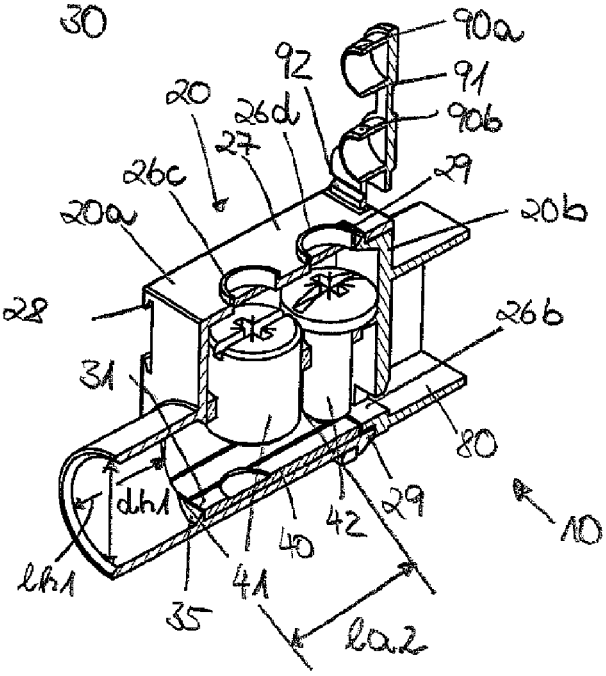
Figure 3:
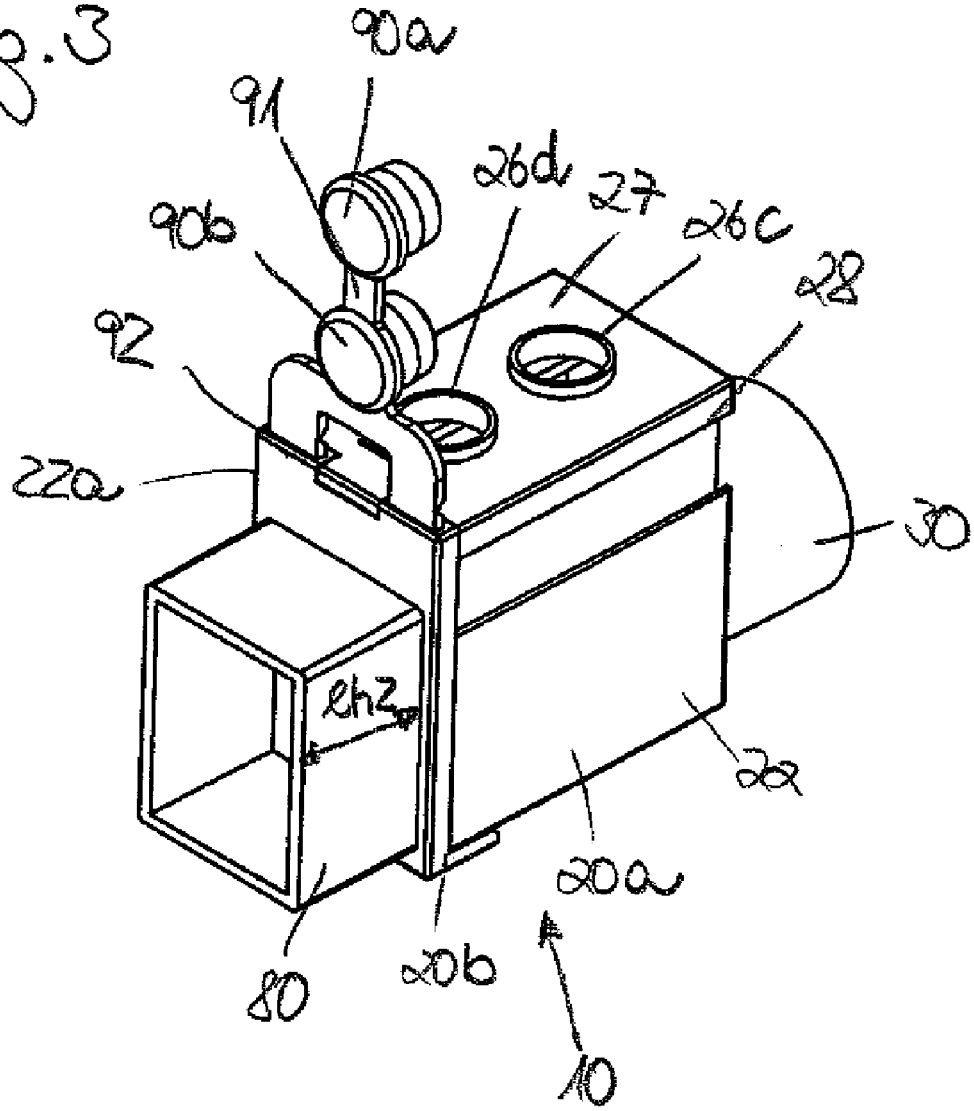
Figure 4:
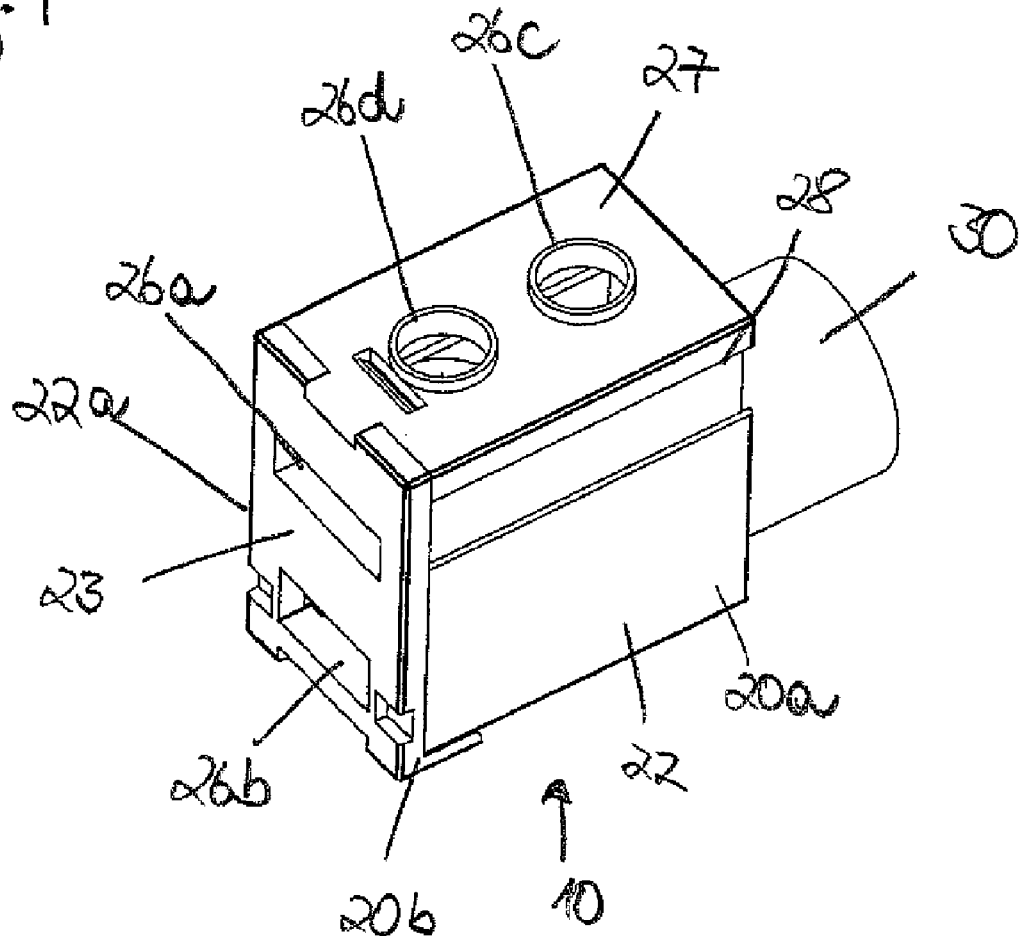

The exploded representation of an illustrative embodiment of a connecting terminal 10 with a housing 20 comprised of an insulating plastic and a clamp body comprised of an electrically conductive metal is shown in FIG. 1. The housing 20 includes a housing part 20*a*, including a front side 21 with an inlet opening 25, a lower side 24, an upper side 27 as well as a side wall 22 and a not shown second side wall, and a housing part 20*b* which forms the back side 23 of the housing 20. The housing part 20*a* is shown sectioned while the housing part 20*b* and the clamp body 40 are represented in an intact perspective view. FIG. 2 shows a connecting terminal according to FIG. 1 in assembled condition, wherein in this representation both the housing part 20*a* as well as the housing part 20*b* and the clamp body 40 are shown in sectional representation, FIG. 3 shows the connecting terminal according to FIG. 1 in a perspective view with a view upon the back side 23 of the housing.

Between the two housing parts 20*a*, 20*b* a clamp body 40 is shown in FIG. 1, which is comprised of a main section with an essentially quadratic cross section, of which the inlet opening joins with the inlet opening 25 of the housing part 20*a*. On the upper side of the clamp body 40 two threaded bores are introduced. In the threaded bore located closer to the front side 21 of the housing part 20*a* a first clamp screw 41 is screwed in, in the second threaded bore a second clamp screw 42 is screwed in. These clamp screws 41, 42 are accessible through two openings 26*c*, 26*d* in the upper side 27 of the housing wherein the opening 26*c* is shown above the closer to the front side 21 of the housing part 20*a* located threaded bore and a clamp screw 41, while the opening 26*d* is located above the threaded bore and the clamp screw 42 located closer to the back side 23 of the housing 20. The first clamp screw 41 serves for fixing a connector cable 50 introduced through the inlet opening 25 in the housing 20, comprised of an internal conductor 52 and an insulation 54. For this the connector cable 50 is stripped along an axial length 1*a*1, so that the internal conductor 52 is exposed. The exposed inner conductor 52 is pressed by the first clamp screw 41 against the inner side of the clamp body 40, whereby the contact between the clamp block 40 and the connector cable 50 is established. Therein preferably in the lower end of the clamp screw 41 a funnel recess is provided, with which the cable can be slightly penetrated, in order to improve contact. In the back side 23 of the housing part 20*b* at least one, in the present illustrative embodiment two outlet openings 26*a*, 26*b* are provided. These can be seen particularly in the illustrative embodiment shown in FIG. 4, which is essentially identical to the illustrative embodiment shown in FIGS. 1 through 3, in which for improved understandability however the back side 23 is shown without a hollow cylinder 80 as described in greater detail below. Through the inlet opening 26*a*, 26*b* a not shown terminal lug of a not shown busbar is introduced into the housing 20 and pressed against the clamp body 40 by means of the two clamp screws 42. One of the outlet openings 26*a* is provided flush with the upper side of the clamp body 40 so that a fork-shaped terminal lug inserted through the inlet opening 26 extends around the shaft of the clamp screw 42 and by means of the clamp screw 42 is pressed against the upper side of the clamp body. The second outlet opening 26 is provided at the back side 23 of the housing part 20*b* such that by the inserted bar-shaped terminal lugs can be pressed by means of the second clamp screw 42 against the lower inner side 43 of the clamp body 40. Depending upon the design of the busbar and the terminal lugs one of the two outlet openings 26*a*, 26*b* can be used for connection of the connecting terminals to the busbar. Since the clamp body 40 is produced from a conductive material, a contact is established between the connector cable 50 and the busbar by clamping of the terminal lug of the busbar by the second clamp screw 42 and the internal conductor 52 of the connector cable 50 by the first clamp screw 41, so that the busbar can be supplied via the connector cable 50 with current or voltage or can be further connected.

Around the inlet opening 25 located at the front side 21 there is perpendicular to the front side 21 is provided a first cylindrical hollow cylinder 30 with axial length 1*h*1 formed unitarily with a housing part 20*a*. By the provision of the hollow cylinder 30 at the inlet opening 25 the air gap between the stripped part of the connector cable 50, which lies either completely within the inner space of the clamp body 40 or extends or projects slightly from the inlet opening 25, and increases the outer surface of the housing 20 at least by the axial length 1*h*1 of the hollow cylinder 30 so that a contacting of the uninsulated part 52 of the connector cable 50 is reliably prevented. Preferably the axial length 1*h*1 of the hollow cylinder 30 is at least 1.27 cm or ½ inch. By this design the connecting terminal 10 satisfies the requirements of UL 508 or UL 489 which required that a air gap of at least one inch and a creepage distance of at least two inches must be provided.

A second cylindrical hollow cylinder 80 with an axial length 1*h*2 is formed perpendicular to the back side 23 unitarily with a housing part 20*b* around or about one or both of the outlet openings 26*a*, 26*b* located at the back side 23. By the provision of the hollow cylinder 80 at the outer opening 26*a*, 26*b* the air gap between the terminal lug and the outer surface of the housing 20 is increased at least by the axial length 1*h*2 of the hollow cylinder 80, so that a contacting of the terminal lug is reliably prevented. Preferably the axial length 1*h*2 of the hollow cylinder 80 is 11 mm, or likewise approximately 1.27 cm or ½ inch. By this dimensioning the connecting terminal 10 satisfies the requirements of UL 508 or as the case may be UL 489, which require, that an air gap of at least one inch and a creepage distance of at least two inches must be provided.

The requirements of UL 508 or as the case may be UL 489 are likewise realized thereby, when the openings 26*c*, 26*d* are closeable or sealable above the clamp screws 41, 42 by the two plugs 90*a*, 90*b*. The plugs 90*a*, 90*b* are introduced into the openings 26*c*, 26*d*, in order to increase the air gap and creepage distance between the conductor clamp screws 41, 42 and the outer side of the housing 20 and to reliably prevent a contacting of the clamp screws 41, 42 by the user. The two plugs 90*a*, 90*b* are connected with each other by a connector piece 91 and namely with that amount of separation which corresponds to the separation between the two openings 26*c*, 26*d* in the upper side 27 of the housing 20, so that both openings 26*c*, 26*d* can be closed simultaneously with a single element. In particular the two plugs 90*a*, 90*b* are linked by a living hinge 92 to the upper side 27 of the housing 20, in particular to a housing part 20*b*, wherein the pivoting of the two plugs 90*a*, 90*b* connected by the connector piece 91 about the living hinge 92 in the direction of the upper side 27 of the housing 20 the plugs 90*a*, 90*b* come to lie against the openings 26*c*, 26*d*. By the hinged plugs 90*a*, 90*b* it is avoided that individual or loose plugs exist, which could be lost. In particular the user is reminded by the presence of the plugs 90*a*, 90*b*, to close the openings 26*c*, 26*d* using the plugs 90*a*, 90*b*.

Both the inlet openings 25 as well as also the first hollow cylinder 30 can have any desired cross section, preferably they are however squared, quadratic, oval or round, particularly preferred is a quadratic or round cross section. The same applies for the cross section of the clamp body 40 as well as the outlet openings 26*a*, 26*b* and the second hollow cylinder 80.

The clamp body 40 exhibits, on the end facing the back side 23 of the housing 20, a continuous perpendicular recess 45 along two respective vertical outer edges, which serves to increase the creepage distance between the clamp bodies 40 serially oriented connecting terminals.

In one preferred illustrative embodiment the inner contour of the clamp body 40 corresponds essentially to the outer contour of the inlet opening 25 and is flush in the mounted condition therewith (see FIG. 2). In particular thereby as a result of the insertion of the clamp body 40 and the housing part 20*a*, the clamp body 40 comes to lie in front of the inlet opening 25 and cannot be pressed therethrough, which simplifies assembly. After insertion of the clamp body 40 with the clamp screws 41 and 42 in the housing part 20*a* the housing part 20*b* is seated upon the housing part 20*a* and the two housing parts 20*a*, 20*b* are locked or engaged by the detent or snap fit by the resulting form-locking connection 29. For this the housing part 20*b* passes with an opening below the lower edge of a detent nose on the lower side of the housing part 20*a*. Then the housing part 20*b* is pressed against the bottom side of the housing part 20, wherein a catch or detent spring tongue engages in the upper edge of the housing part 20*b* behind an inner edge of the upper side of the housing part 20*a*. The connecting terminal 10 can therewith be particularly simply assembled, in particular it is ensured by the locking engagement that between the housing part 20*a* and the housing part 20*b* no air gap remains, so that a reliable protection is provided against sparkover or arcing between electrically conductive components lying against the housing and the user. By a circumscribing projection 29*a* line in the inner side of the housing part 20*b*, which lies partially against the inner side of the housing part 20*a* upon seating of the housing part 20*b* upon the housing part 20*a* and therewith increases the air gap and creepage distance. On the basis of this circumscribing projection 29*a* the axial length 1*h*2 of the second hollow cylinder 80 can be dimensioned to be approximately shorter by ½ inch, since the second hollow cylinder 80 is axially lengthened by the circumscribing projectional 29*a*, so that also in the case of an axial length 1*h*2 of 11 mm, as a result of the projectional 29*a* the total length is approximately ½ inch.

The inner dimension of the inlet opening 25 corresponds preferably to approximately the outer diameter of the internal conductor 52 of the connector cable 50. In the case of a square cross section of the inlet opening 25 at least the inner diameter, for example the height de, corresponds to the cross section of the inlet opening 25 of the outer diameter of the internal conductor 52 of the connector cable 50. By this dimensioning it is ensured that the insulation 54 of the connector cable 50 does not penetrate through the inlet opening 25 into the clamp body 40 located in the internal space of the housing 20, so that only the stripped part of the connector cable 50 can come to lie in the inner space of the clamp body 40 and become fixed by the first clamp screw 41 and therewith ensures contact between the connector cable 50 and the clamp body 40.

In the illustrative embodiment of the connecting terminal 10 represented in the figures the inner diameter de of the inlet opening 25 is smaller than the inner diameter dh of the hollow cylinder 30. As a result an edge 31 is created in the inlet opening 25 (see FIG. 2), at which, in the case that the inner diameter de of the inlet opening 25 corresponds to the outer diameter of the internal conductor 52 of the connector cable 50, the insulation 54 of the connector cable 50 abuts.

Therewith it is on the one hand possible to establish a defined penetration depth of the internal conductor 52 and on the other hand it is ensured that the insulation 54 of the connector cable 50 reaches precisely to the inlet opening 25 of the housing 20 and therewith the air gap between the stripped part of the connector cable 50 and the outer surface of the housing 20 is as large as possible. The separation 1*a*2 between the inlet opening 25 of the housing 20 and the second clamp screw 42 is known. So that the internal conductor 52 of the connector cable 50 does not come into contact with the second clamp screw 42 and impede the manner of function of the second clamp screw 42, the axial length 1*a*1 of the stripped part 52 of the connector cable should be smaller than the separation 1*a*2 between the inlet opening 25 of the housing 20 and the second clamp screw 42. Since the insulation adjacent to the stripped part of the connector cable 50 abuts against the edge 31 and therewith cannot penetrate into the inside of the clamp body 40, it is ensured that the free end of the internal conductor 52 does not come into contact with the second clamp screw 42.

In order to facilitate the insertion of the internal conductor 52 of the connector cable 50 into the inlet opening 25 and to prevent that this catches on the edge 31, becomes damaged or cannot be inserted through the inlet opening into the inside of the clamp body 40, a guide slope 35 is provided in the transition area between the hollow cylinder 30 and the inlet opening 25, which extends from the inner surface of the hollow cylinder 30 to the edge 31. Preferably at least one insertion guide slope 35 as shown in FIG. 2 is provided within the inlet opening 25, so that the connector cable 50 to be inserted, which should come to rest upon the floor of the inner space of the hollow cylinder 30, is guided via the inlet guide slope 35 into the inlet opening 25 without becoming caught on the edge 31.

So that the connector cable 50 can be introduced into the hollow cylinder 30 without effort, the inner diameter of the hollow cylinder 30 is larger than the outer diameter of the connector cable 50 inclusive of the insulation 54.

The inner diameter of the inlet opening 25 is so large, that the cross section of the inlet opening 25 is more than 35 millimeter across, preferably approximately 50 millimeter across, so that even a cable with a comparatively large cross section can be simply and reliably connected in the connecting terminal 10. For example the inner diameter de of the inlet opening 25 is approximately 13.5 mm.

In a preferred embodiment the connecting terminal 10 is designed to be provided in series and exhibits for this on the side wall 22 at least one groove 28 running parallel to the upper side 27 of the housing 20. On the opposite lying side wall 22*a* (not shown in FIGS. 1 and 2) there could be provided in a first embodiment a correspondingly shaped not shown projection. If two essentially identically designed connecting terminals 10 are to be provided adjacent to each other, the groove 28 of the first connecting terminal 10 can be inserted upon the correspondingly shaped projection of the other connecting terminal 10, so that the connecting terminals 10 are joined and cannot tilt relative to each other. An alternative embodiment (not shown in FIGS. 1 and 2) there is provided on the opposite lying side 22*a* likewise a groove. In order to position two essentially identically designed connecting terminals 10 adjacent to each other, a feather key 70, which on both sides is shaped complimentary to the groove 28 (see FIG. 1), is introduced into the two grooves 28, whereby the two connecting terminals 10 are joined to each other. The advantage of the design of respectively one groove 28 on the two side walls 22, 22*a* lies therein, that so long as the side walls 22, 22*a* exhibit no projection, there is no increase in the breadth of the connecting terminal 10, so that the normal breadth of the connecting terminal 10 of 17.5-18.0 mm can be maintained. As shown in FIGS. 1 through 3, the groove 28 has a dovetail design to ensure a simple however reliable connecting of multiple connecting terminals.

Figure 5:
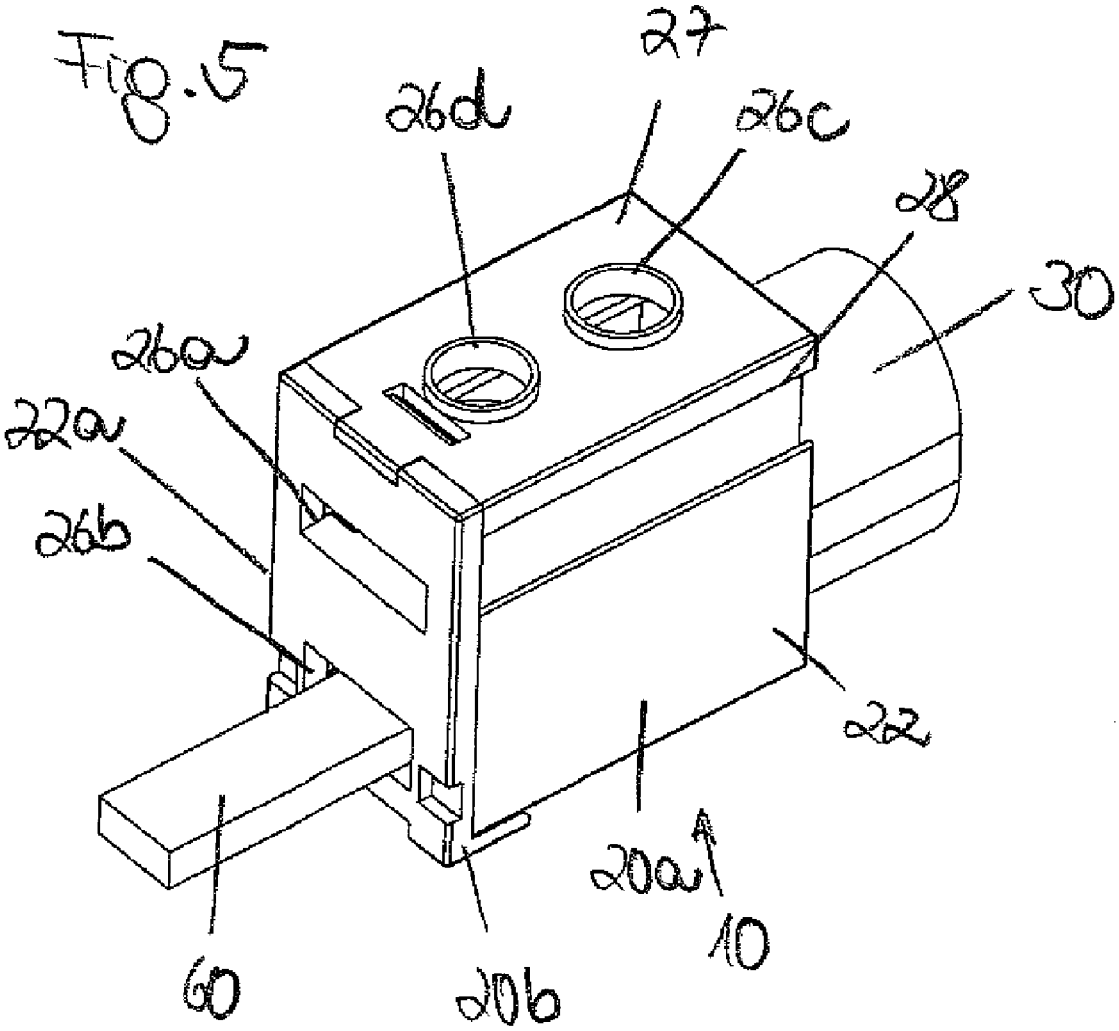

A further embodiment of the invention is shown FIG. 5. In the first instance the connecting terminal 10 shown in FIG. 5 is identical to the connecting terminals shown in FIGS. 1 through 3, wherein the same reference numbers designate the same parts. Again, for better overview the second hollow cylinder 80 is not shown. The illustrative embodiment shown in FIGS. 1 through 3 is so designed to receive a terminal lug provided on a not shown busbar through the outlet opening 26*a* or the outlet opening 26*b* and to fix this by means of clamp screws 42 in the clamp body 40. The connecting terminal 10 shown in FIG. 4 exhibits in addition a cross bar 60 integrated in the connecting terminal 10 which is introduced through the outlet opening 26*b* or alternatively also through the outlet opening 26*a* (not shown) into the housing 20 and there is fixed by means of the clamp screws 42 or alternatively is not releasably fixed, for example, by soldering. In this illustrative embodiment the connecting terminal with the terminal lug 60 can be employed in a clamp connection of an installed device. The terminal lug 60 can also be employed together with a terminal lug of a busbar in an installed device, for example an automatic circuit breaker and be clamped. The lower inner side 43 of the clamp body 40 is designed to be planar (see FIG. 1) with a terminal lug 60 of corresponding breadth, so that the terminal lug 60, which is pressed by the clamp screw 42 against the lower inner side 43 of the clamp body 40, lays with flat or flush contact on the lower inner side 43, whereby the largest possible contact surface area is ensured.

REFERENCE NUMBER LIST

10 Connecting Terminal
20 Housing
20*a* Housing Part
20*b* Housing Part
21 Front Side
22 Side Wall
22*a* Side Wall
23 Back Side
24 Lower Side
25 Inlet Opening
26*a* Outlet Opening
26*b* Outlet Opening
26*c* Opening
26*d* Opening
27 Upper Side
28 Groove
29 Detent Connection
29*a* Projection
30 First Hollow Cylinder
31 Edge
35 Guide slope
40 Clamp Body
41 First Clamp Screw
42 Second Clamp Screw
43 Lower Inner Side
45 Recess or Cut-out
50 Connector Cable
52 Internal conductor
54 Insulation
60 Terminal Lug

70 Feather Key
80 Second Hollow Cylinder
90*a* Plug
90*b* Plug
91 Connector piece
92 Living Hinge
1*h*1 Axial Length of the First Hollow Cylinder
1*h*2 Axial Length of the Second Hollow Cylinder
de Inner Diameter of the Inlet Opening
dh1 Inner Diameter of the Hollow Cylinder
1*a*1 Axial Length of the Stripped Part of the Connector Cable
1*a*2 Spacing

The invention claimed is:

1. A connecting terminal (10) for a busbar, comprising:

an electrically insulated housing (20), in which an electrically conductive clamp body (40) is provided with a first clamp screw (41) for fixing a connector cable (50) and a contact for a terminal lug (60), wherein the clamp body (40) is adapted for receiving the connector cable (50) through an inlet opening (25) of the housing (20), and wherein the housing (20) is adapted to receive the terminal lug (60) through an outlet opening (26*a*, 26*b*) of the housing (20), an electrically insulated hollow cylinder (30) projecting from the electrically insulated housing (20) and leading to the inlet opening (25), and an electrically insulated hollow cylinder (80) projecting from the electrically insulated housing (20) and leading to the outlet opening (26*a*, 26*b*) of the terminal lug (60).

2. The connecting terminal according to claim 1, wherein the hollow cylinder (30, 80) has an axial length (1*h*1, 1*h*2) of at least ½ inch.

3. The connecting terminal according to claim 1 wherein the hollow cylinder (30, 80) extends approximately perpendicularly from a housing surface (21).

4. The connecting terminal according to claim 1, wherein the hollow cylinder (30, 80) exhibits a round, oval or quadratic cross section.

5. The connecting terminal according to claim 1, wherein two openings (26*c*, 26*d*) are provided in the housing (20) in such a manner that the first clamp screw (41) and a second clamp screw (42) can be actuated through the two openings (26*c*, 26*d*).

6. The connecting terminal according to claim 5, wherein a hollow cylinder is provided around at least one of the two openings (26*c*, 26*d*), preferably about both of the two openings (26*c*, 26*d*).

7. The connecting terminal according to claim 5, wherein a plug (90*a*, 90*b*) is introducible in the at least one of the two openings (26*c*, 26*d*), preferably in both of the two openings (26*c*, 26*d*).

8. The connecting terminal according to claim 7, wherein the two plugs (90*a*, 90*b*) are provided on a connector piece (91) with a separation which corresponds to the separation between the two openings (26*c*, 26*d*) in the housing (20).

9. The connecting terminal according claim 8, wherein the connecting piece (91) is linked to the housing (20), preferably via a living or flexible hinge (92).

10. The connecting terminal according to claim 1, wherein an inner diameter (de) of the inlet opening (25) is smaller than an inner diameter (dh) of the hollow cylinder (30).

11. The connecting terminal according to claim 1, wherein an inner diameter (de) of the inlet opening (25) corresponds approximately to a diameter of an internal conductor (52) of the connector cable (50).

12. The connecting terminal according claim 1, wherein an inner diameter (dh) of the hollow cylinder (30) is larger than an outer diameter of the connector cable (50).

13. The connecting terminal according to claim 1, wherein at least one guide slope (35) is provided in a transition area between the hollow cylinder (30) and the housing (20).

14. The connecting terminal according to claim 13, wherein, in the assembled condition of the housing (20), at least one guide slope (35) is provided below the inlet opening (25).

15. The connecting terminal according to claim 13, wherein the connecting terminal (10) is designed for arrangement in series.

16. The connecting terminal according to claim 15, wherein a groove (28) is provided running parallel to an upper side (27) of the housing (20) in at least one of side walls (22, 22*a*) of the housing (20).

17. The connecting terminal according to claim 16, wherein a feather key (70) is introducible in a groove (28) running parallel to the upper side (27) of the housing (20) in one or both side walls (22, 22*a*) of the housing (20).

18. The connecting terminal according to claim 16, wherein the at least one groove (28) has a dove tail design.

* * * * *